US006955053B1

(12) United States Patent
Chen et al.

(10) Patent No.: US 6,955,053 B1
(45) Date of Patent: Oct. 18, 2005

(54) PYROSPIN COMBUSTER

(75) Inventors: Daih-Yeou Chen, San Diego, CA (US); Chris Hayden, San Diego, CA (US); Dietmar Trees, San Diego, CA (US); Paul Piconi, LaJolla, CA (US); Tony Reichmann, El Cajon, CA (US); Jack Vitale, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 110 days.

(21) Appl. No.: 10/186,640

(22) Filed: Jul. 1, 2002

(51) Int. Cl.[7] ..... F23R 3/54

(52) U.S. Cl. ..... 60/804; 60/752

(58) Field of Search ..... 60/804, 752

(56) References Cited

U.S. PATENT DOCUMENTS

| | | | | |
|---|---|---|---|---|
| 5,129,231 | A * | 7/1992 | Becker et al. | 60/754 |
| 5,263,316 | A * | 11/1993 | Shekleton | 60/804 |
| 5,317,864 | A * | 6/1994 | Shorb et al. | 60/804 |
| 5,323,602 | A * | 6/1994 | Defever | 60/804 |
| RE34,962 | E * | 6/1995 | Shekleton et al. | 60/804 |
| 5,918,467 | A * | 7/1999 | Kwan | 60/754 |
| 6,408,629 | B1 * | 6/2002 | Harris et al. | 60/804 |
| 6,729,141 | B2 * | 5/2004 | Ingram | 60/804 |

* cited by examiner

*Primary Examiner*—Ehud Gartenberg
(74) *Attorney, Agent, or Firm*—Stephen G. Mican

(57) ABSTRACT

An annular combustor that has angled effusion holes through at least one surface of the combustor liner with the angle of the effusion holes oriented to cause the flow of air through the holes to facilitate swirling of the fuel and air within the combustor. The effusion holes thereby facilitate efficient cooling of the combustor liner combined with superior fuel/air mixing within the combustor.

6 Claims, 11 Drawing Sheets

PYROSPIN COMBUSTER

BACKGROUND OF THE INVENTION

For a gas turbine engine that employs an annular combustor with radial fuel injection, it has long been known that achieving uniform annular circumferential swirl of fuel and air downstream of the primary combustion zone provides a much more uniform mix to provide a more uniform burn. This results in more annular circumferential uniformity in the turbine inlet temperature. It has been common to provide cooling strips along the inner and outer annular walls, as well as the dome, of the combustor to facilitate this annular circumferential swirl. Such cooling strips baffle air that flows through adjacent film cooling holes in a generally annular circumferential direction. The film cooling holes release pressurised air.

Although these cooling strips are effective in facilitating good fuel and air mixing and enhancing fire spinning within the combustor, the efficiency of the swirling effect provided by the flow of the air through the film cooling holes is prohibited by the strips. This is because the strips cause cooling air momentum loss, thereby reducing efficient mixing of the fuel and air.

Consequently, the maximum turbine inlet temperature may run higher than necessary and turbine life is thereby shortened. It would be desirable to eliminate the adverse impact of the cooling strips on swirling efficiency of the film cooling holes whilst retaining their beneficial impact on the fuel and air mixing and the fire spinning within the combustor.

SUMMARY OF THE INVENTION

The invention comprises an annular combustor with radial fuel injection, referred to as a "Pyrospin Combustor", that has angled effusion holes through at least one surface of the combustor liner with the angle of the effusion holes oriented to enhance annular circumferential swirling of the fuel and air and the fire spinning within the combustor. The effusion holes thereby facilitate efficient cooling of the combustor liner combined with superior fuel and air mixing and enhanced fire spinning within the combustor.

DESCRIPTION IF THE DRAWINGS

DESCRIPTION OF THE EMBODIMENTS

Figure 1:
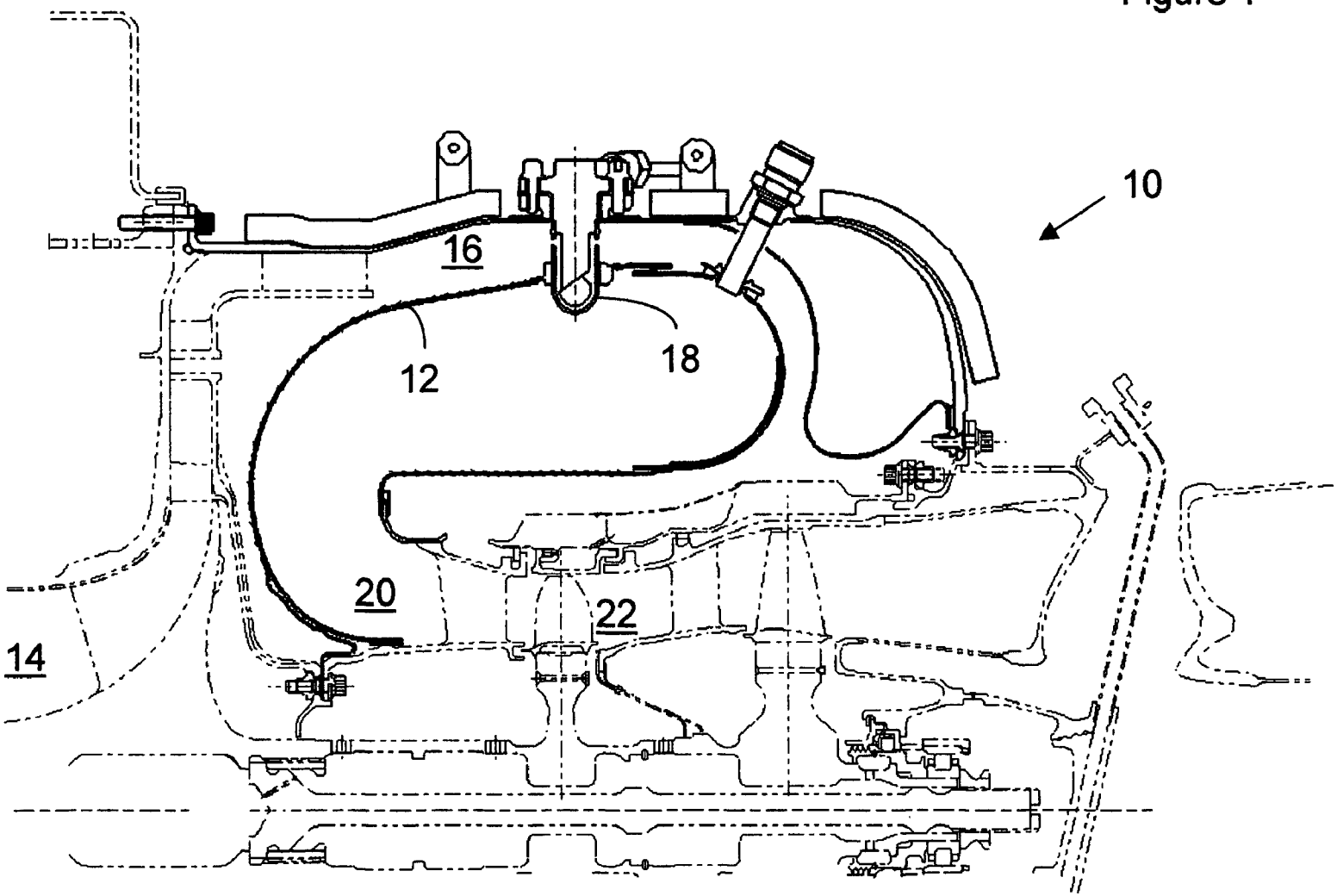
FIG. 1 is a fragmentary sectional view of a turbine that incorporates the invention.

Referring to the drawings, wherein numbered items describe like or corresponding parts throughout the views, FIG. 1 is a fragmentary sectional view of a gas turbine 10 that incorporates the invention. The turbine 10 comprises a "Pyrospin Combustor" 12 that is supplied with compressed air from a compressor section 14 of the turbine 10 through a plenum region 16 that encloses the combustor 12. Compressed air in the plenum region 16 is forced through apertures (not shown) in the liner walls of the combustor 12 and mixed with fuel supplied by a plurality of fuel injectors 18 to initiate combustion. The combustion gases thereby generated are exhausted through a combustor outlet 20 to drive a turbine section 22 of the turbine 10.

Figure 2:
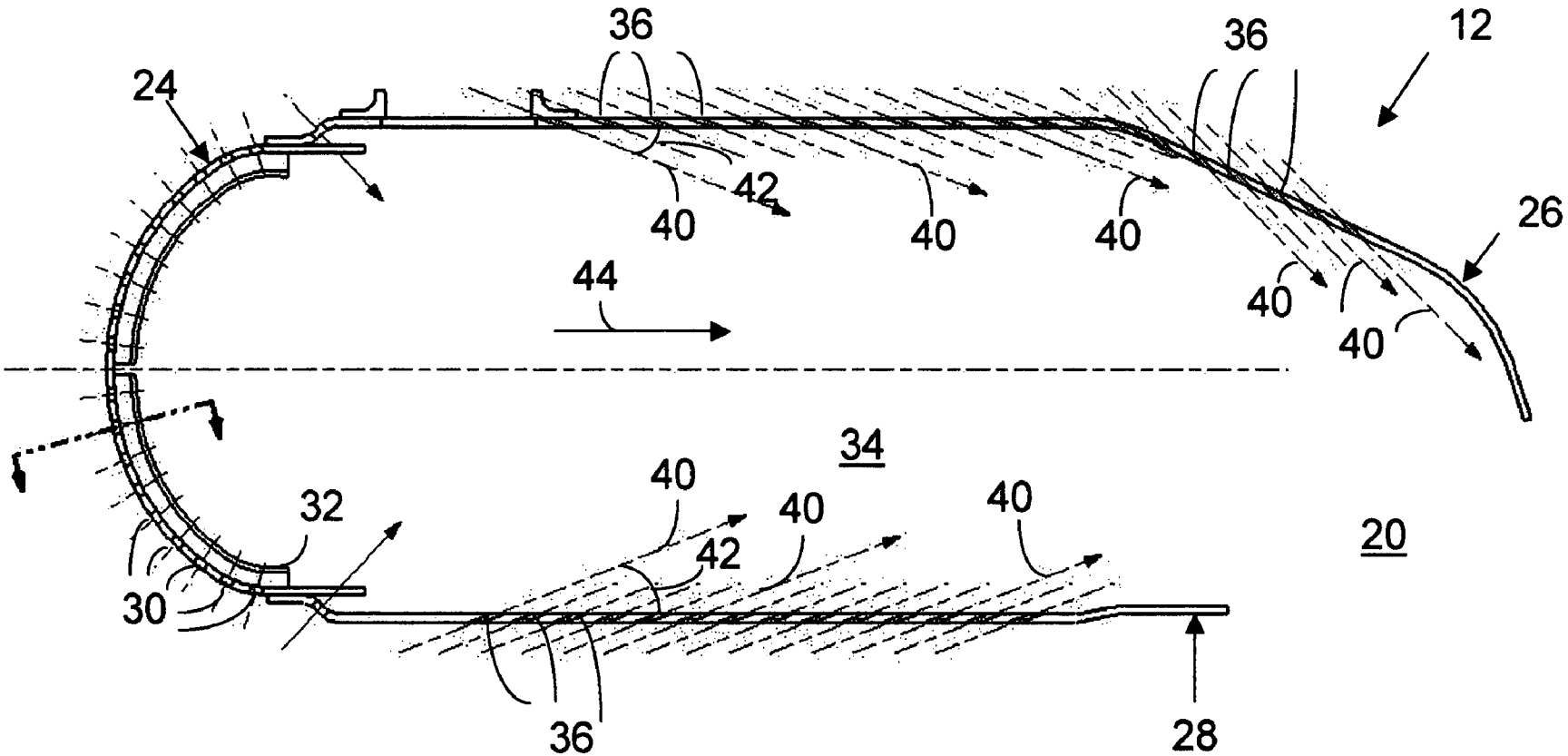
FIG. 2 is a fragmentary sectional side view of a first embodiment of the invention that has dome cooling strips and inner and outer liner wall angled cooling holes.
Figure 3:
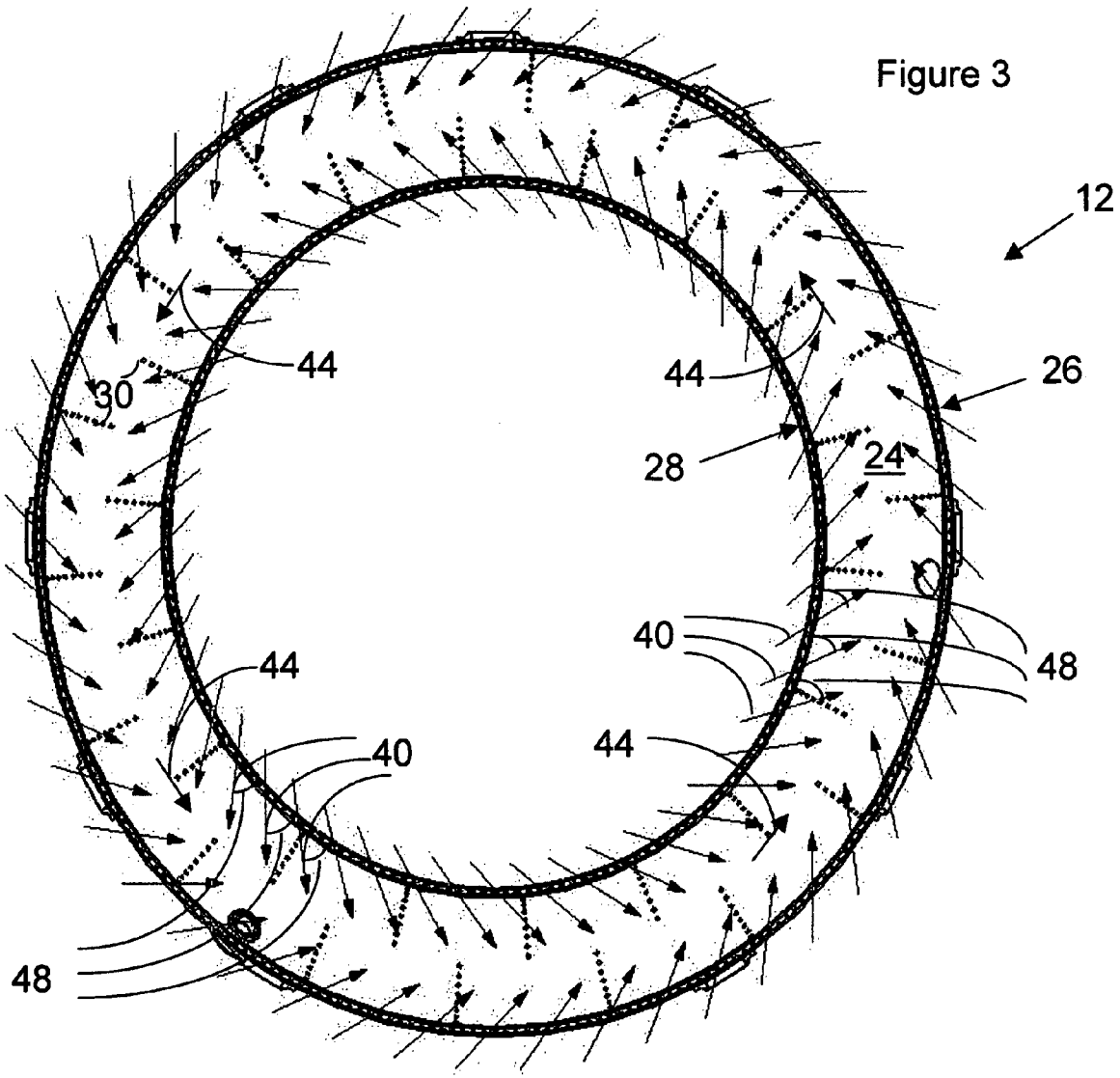
FIG. 3 is an end view of the first embodiment of the invention that has dome cooling strips and inner and outer liner wall angled cooling holes.
Figure 4:
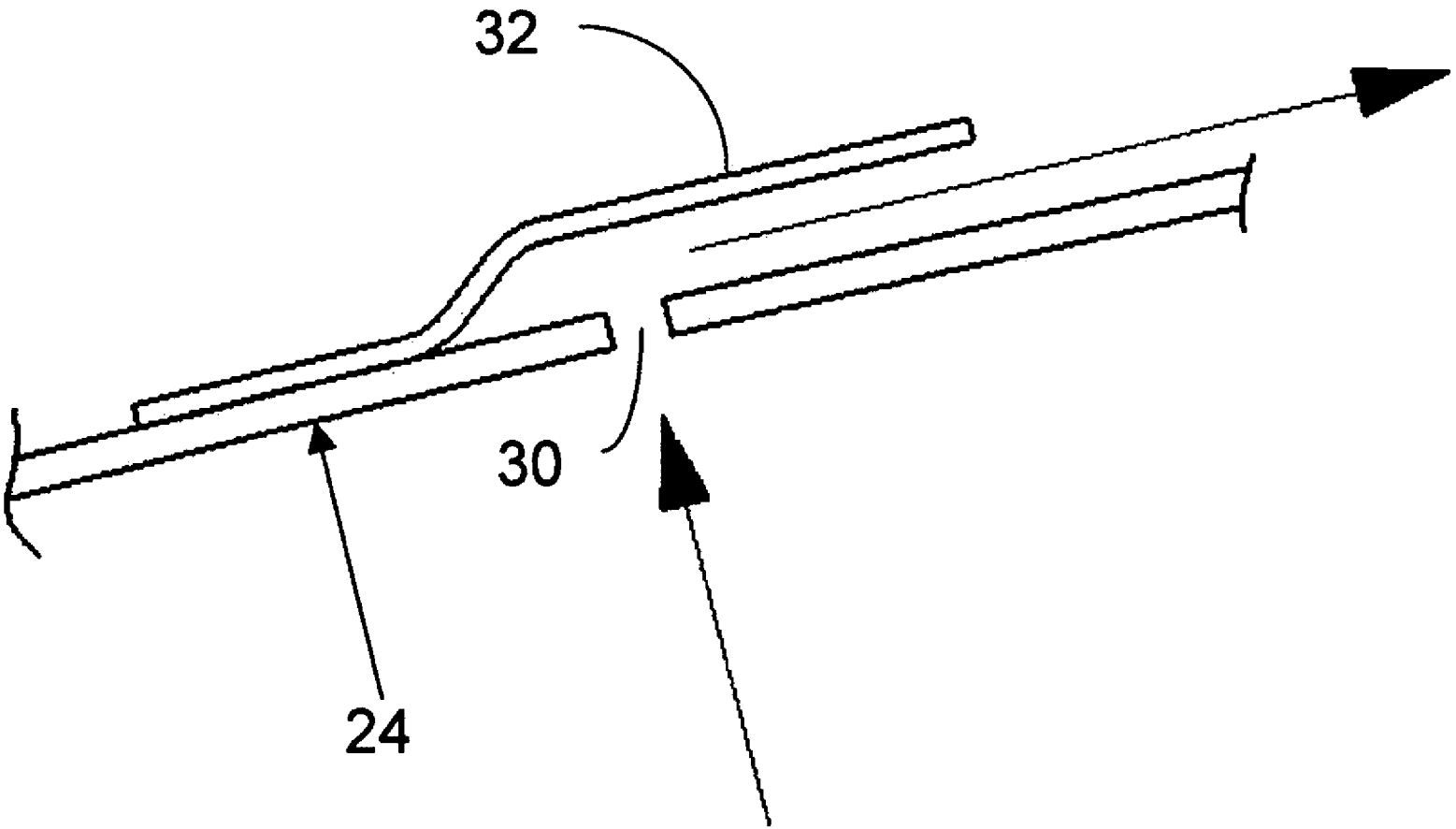
FIG. 4 is a side view of one of the dome cooling strips used in the first embodiment of the invention shown in FIG. 2.

The compressed air that is forced through apertures in the liner walls of the combustor 12, besides serving to oxidise the fuel to support combustion, is used to dilute the combustion gases generated in the combustor 12 and to cool the surfaces of the combustor 12. FIG. 2 is a fragmentary sectional side view of a first embodiment of the invention that has dome cooling strips and inner and outer liner wall angled cooling holes and best illustrates this process. FIG. 3 is an end view of the first embodiment. The combustor 12 has liner surfaces comprising a liner dome 24, a liner outer wall 26 and a liner inner wall 28. The dome 24 has conventional film cooling holes 30 and associated cooling strips 32 to swirl the air forced through the cooling holes 30 generally circumferentially through an annulus 34 of the combustor 12. FIG. 4 is a side view of one of the cooling holes 30 and cooling strips 32 along the dome 24.

In contrast, the outer wall 26 and the inner wall 28 of the combustor 12 have angled effusion cooling holes 36 that are angled to let air blow through them in a direction that is generally tangential to the axial flow of combustion gas in the combustor 12 toward the outlet 20 to swirl the air forced through the angled cooling holes 36 generally circumferentially through the annulus 34 of the combustor 12. By so angling the angled cooling holes 36 to achieve a swirling of the air no associated cooling strips for the angled cooling holes 36 are necessary. The swirled air is able to achieve higher velocity without the cooling strips, so the cooling and swirling actions of the angled cooling holes 36 are superior. The cooling effect is superior in that temperature gradients are reduced and the swirling effect enhances fire spinning within the annulus 34 of the combustor 12 and temperature quality of the combustion gases exhausted through the outlet 20 of the combustor 12.

The angled cooling holes 36 should have circumferential, or swirl, angles through the outer wall 26 and the inner wall 28 in the range of approximately 45 to 90 degrees from the surface of the walls 26, 28 in a direction that is generally tangential to the axial flow of combustion gas in the combustor 12 toward the outlet 20, and downstream, or down, angles in the range of approximately 15 to 45 degrees from the surface of the walls 26, 28 in a direction generally parallel the axial flow of combustion gas in the combustor 12 toward the outlet 20. A typical swirl angle is approximately 60 degrees. A typical down angle is approximately 20 degrees.

In FIG. 2, arrows 40 represent the flow paths of air that flows through the angled cooling holes 36. In particular, down angles 42 of the cooling air passing through the angled cooling holes 36 in the outer wall 26 and the inner wall 28 are evident. Arrows 44 represent the flow path of combustion gases in the combustor 12.

In FIG. 3, swirl angles 48 of the cooling air passing through the angled cooling holes 36 represented by the arrows 40 are evident. Again, the arrows 44 represent the flow path of the combustion gases in the combustor 12, demonstrating the swirling effect that is generated within the combustor 12 in part through the action of the angled cooling holes 36.

Figure 5:
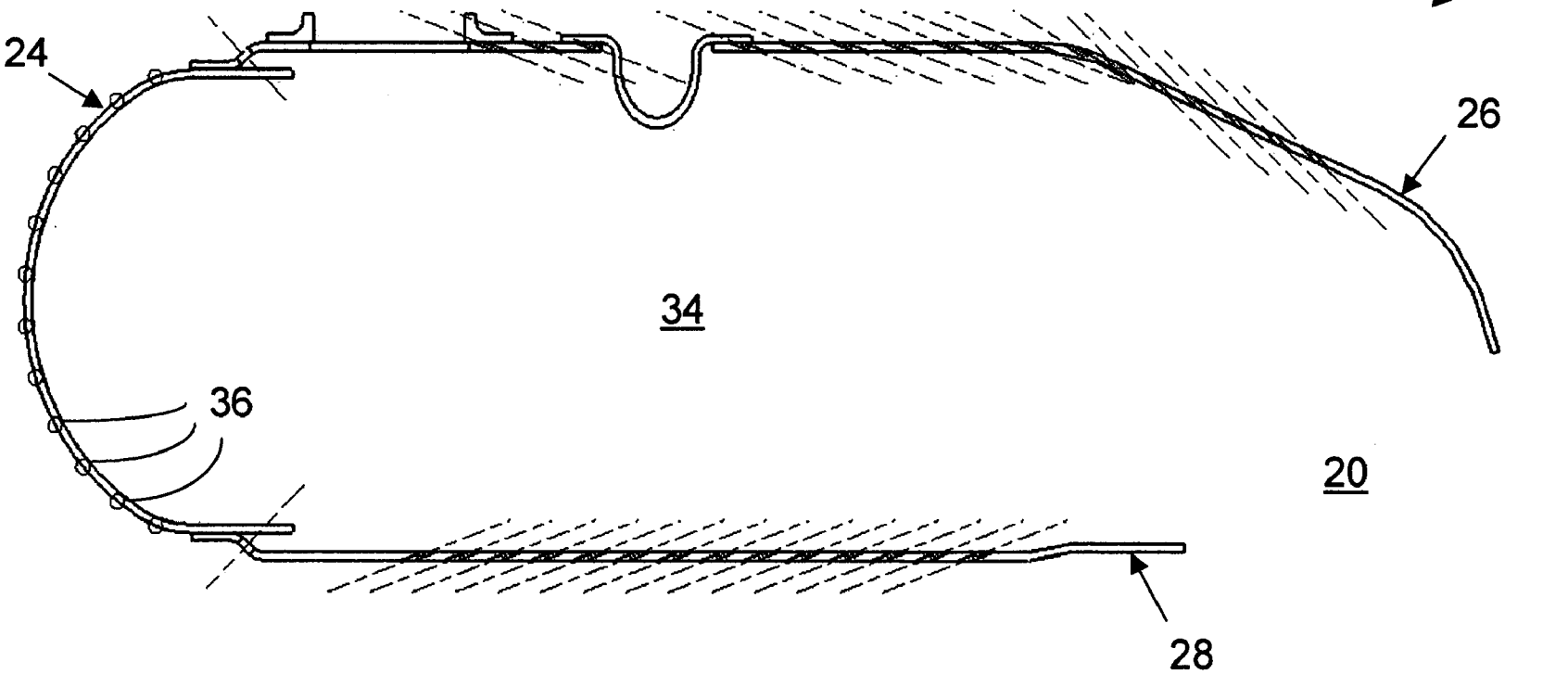
FIG. 5 is a fragmentary sectional side view of a second embodiment of the invention that has dome as well as inner and outer liner wall angled cooling holes.

FIG. 5 is a fragmentary sectional side view of a second embodiment of the invention that has dome as well as inner and outer liner wall cooling holes.

Figure 6:
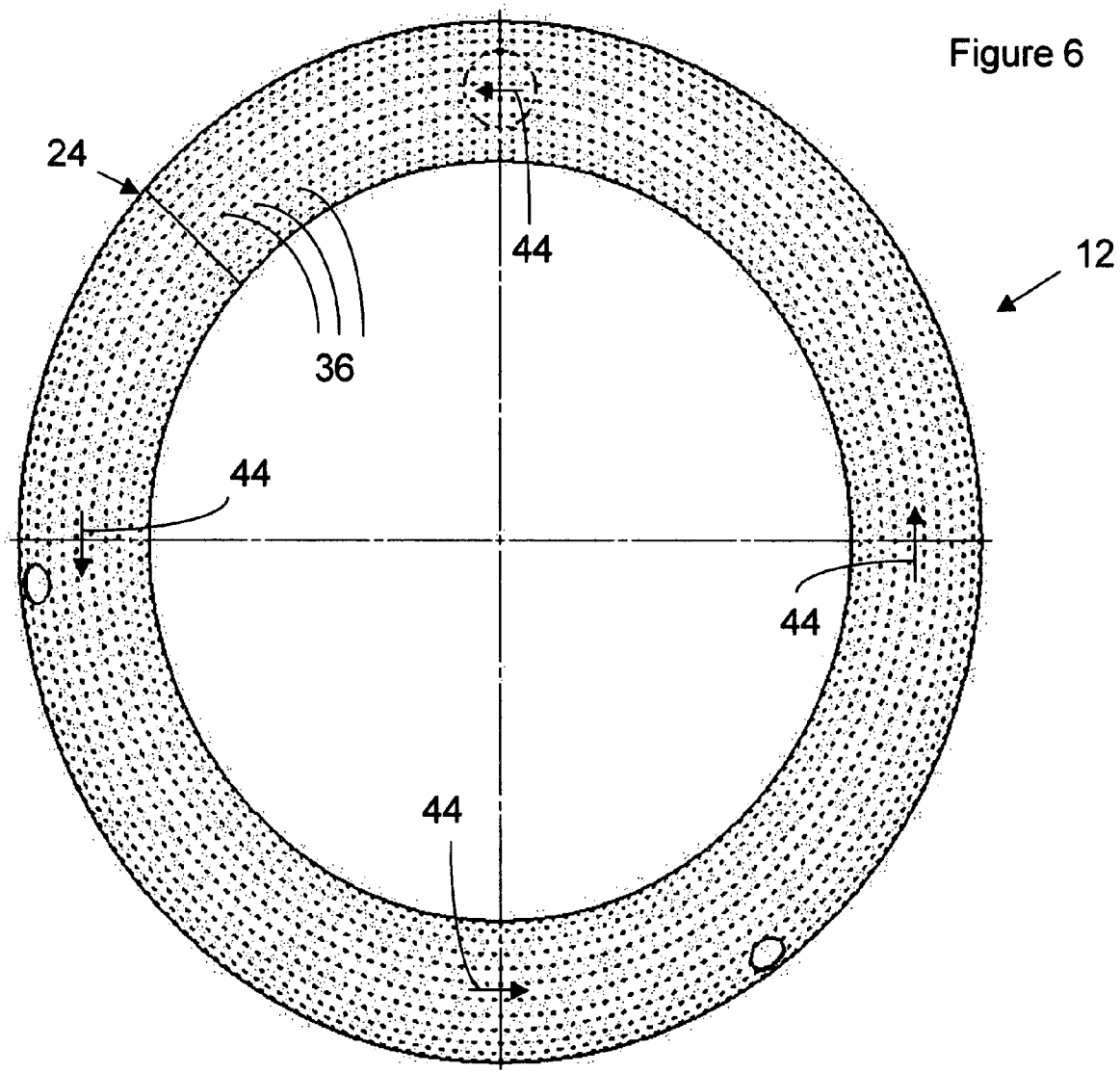
FIG. 6 is an end view of the second embodiment of the invention that has dome as well as inner and outer liner wall angled cooling holes.

FIG. 6 is an end view of the second embodiment. In this embodiment, the combustor 12 has a dome 24 that does not have the film cooling holes 30 and associated cooling strips 32. Instead, it has the angled cooling holes 36 that are angled to let air blow through them in a direction that is generally tangential to the axial flow of combustion gas in the combustor 12 toward the outlet 20 to swirl the air forced through the angled cooling holes 36 generally circumferentially through the annulus 34 of the combustor 12, similar to the angled cooling holes 36 in the outer wall 26 and the inner wall 28. The swirl angle for the angled cooling holes 36 in the dome 24 is preferably in the range of 45 to 90 degrees. A typical swirl angle is approximately 60 degrees.

Figure 7:
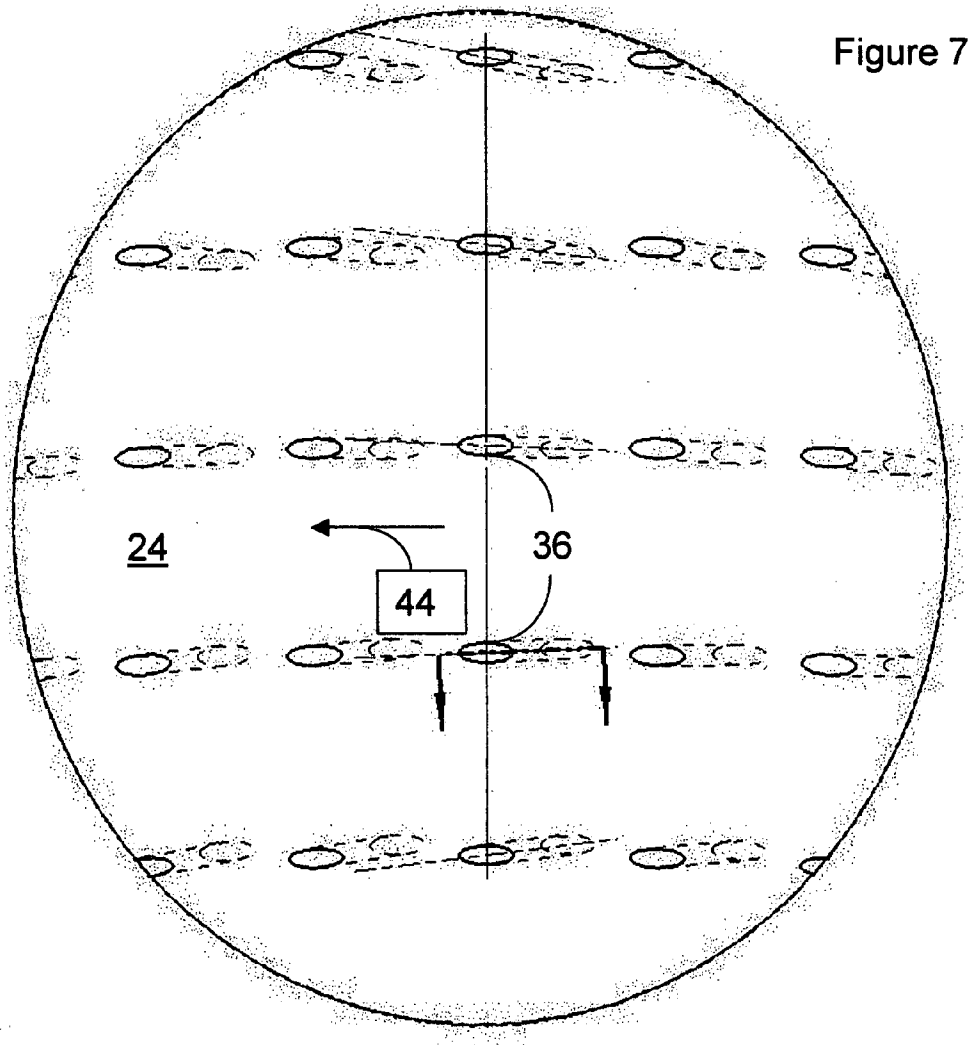
FIG. 7 shows details of the angled holes used in the dome of the second embodiment of the invention shown in FIG. 6.
Figure 8:
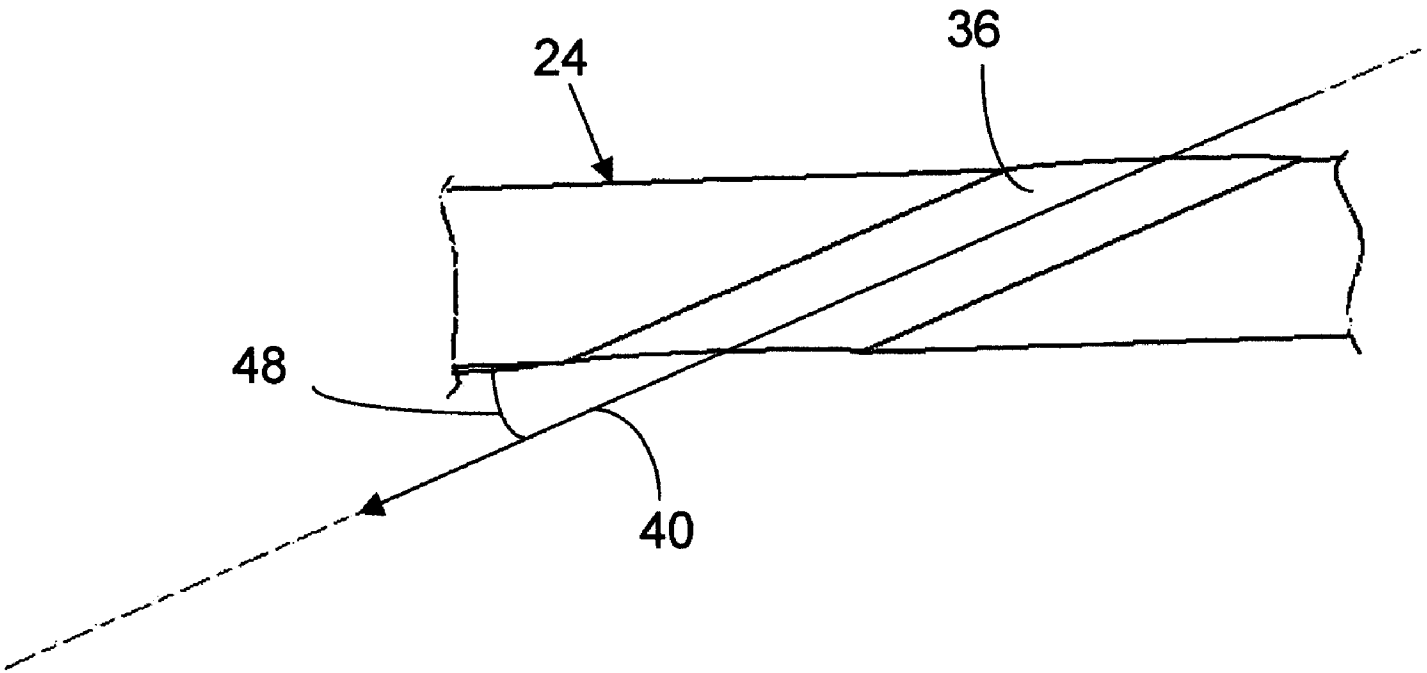
FIG. 8 shows a side view of one of the angled holes used in the dome of the second embodiment of the invention shown in FIG. 6.

FIG. 7 shows details of the angled holes 36 in the dome 24 of the second embodiment. It is evident from FIG. 7 that the angled holes 36 direct air through the dome 24 generally tangential to the axial flow of combustion gas in the combustor 12 toward the outlet 20. FIG. 8 shows a side view of one of the angled holes 36 used in the dome 24 of the second embodiment. In FIG. 8, swirl angle 48 of the cooling air passing through the angled cooling hole 36 represented by the arrow 40 is evident.

Figure 9:
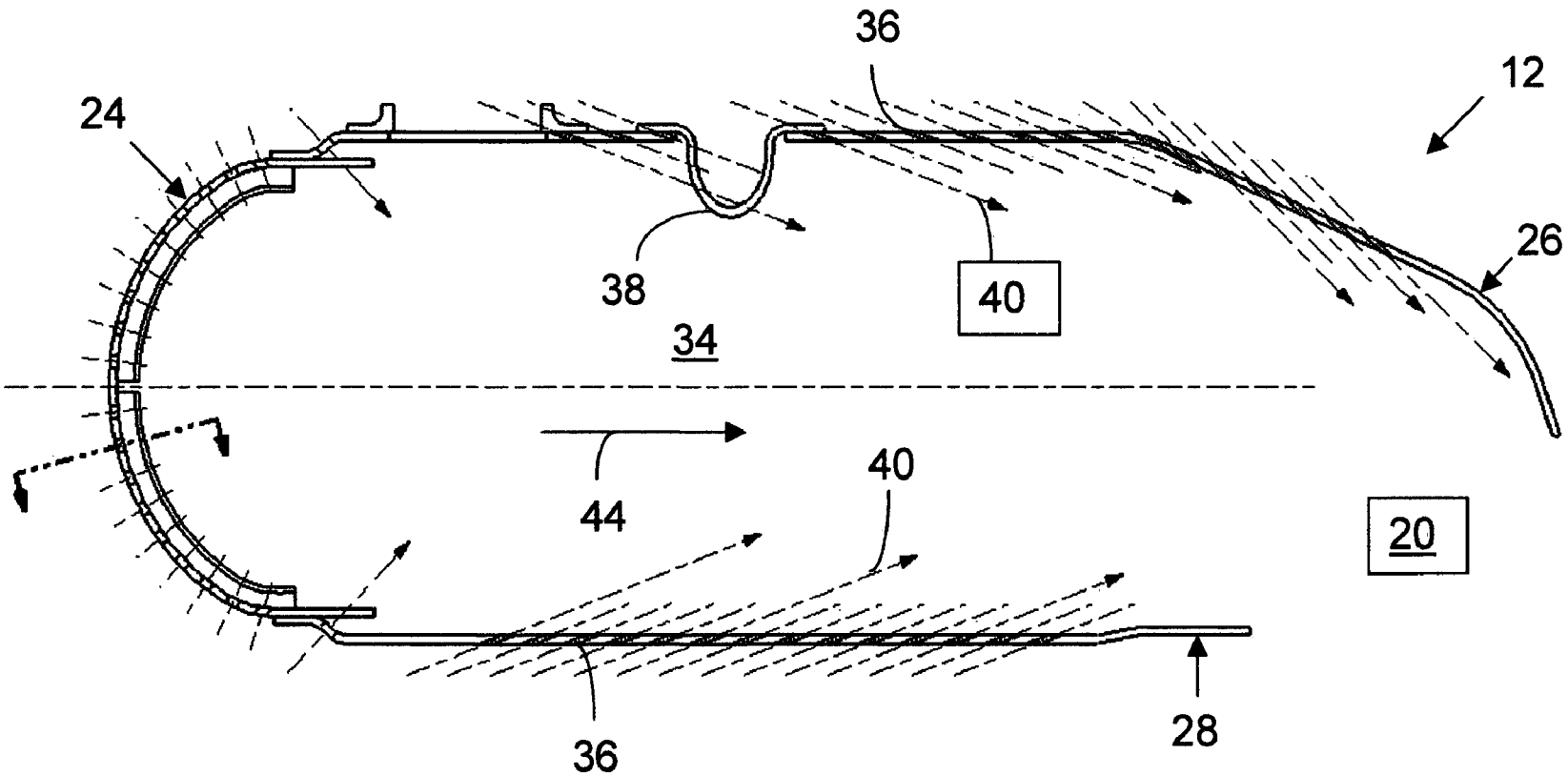
FIG. 9 is a fragmentary sectional side view of a third embodiment of the invention that has blast tubes in combination with dome cooling strips and inner and outer liner wall angled cooling holes.
Figure 10:
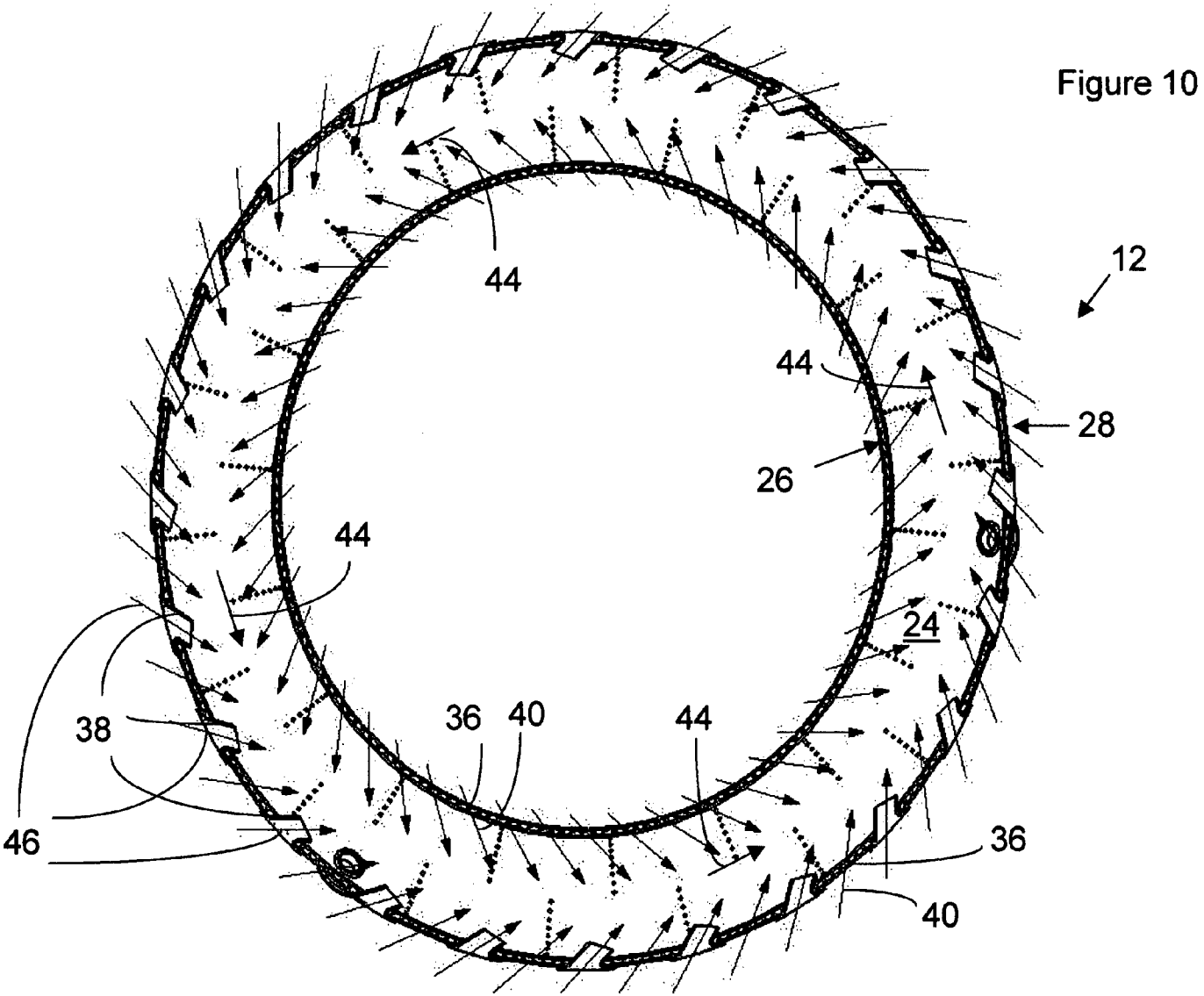
FIG. 10 is an end view of the third embodiment of the invention that has blast tubes in combination with dome cooling strips and inner and outer liner wall angled cooling holes.

FIG. 9 is a fragmentary sectional side view of a third embodiment of the invention. FIG. 10 is an end view of the third embodiment. This embodiment is similar to the first embodiment shown in FIG. 2, but it includes circumferentially angled air blast tubes 38 that further enhance the swirling effect created by the angled cooling holes 36.

In FIG. 9, arrows 40 represent the flow paths of air that flows through the angled cooling holes 36. In particular, down angles 42 of the cooling air passing through the angled cooling holes 36 in the outer wall 26 and the inner wall 28 are evident. Arrows 44 represent the flow path of combustion gases in the combustor 12.

In FIG. 10, swirl angles 48 of the cooling air passing through the angled cooling holes 36 represented by the arrows 40 are evident. Again, the arrows 44 represent the flow path of the combustion gases in the combustor 12 and arrows 46 represent the flow path of the air introduced through the air blast tubes 38, demonstrating the swirling effect that is generated within the combuster 12 in part through the action of the angled cooling holes 36.

Figure 11:
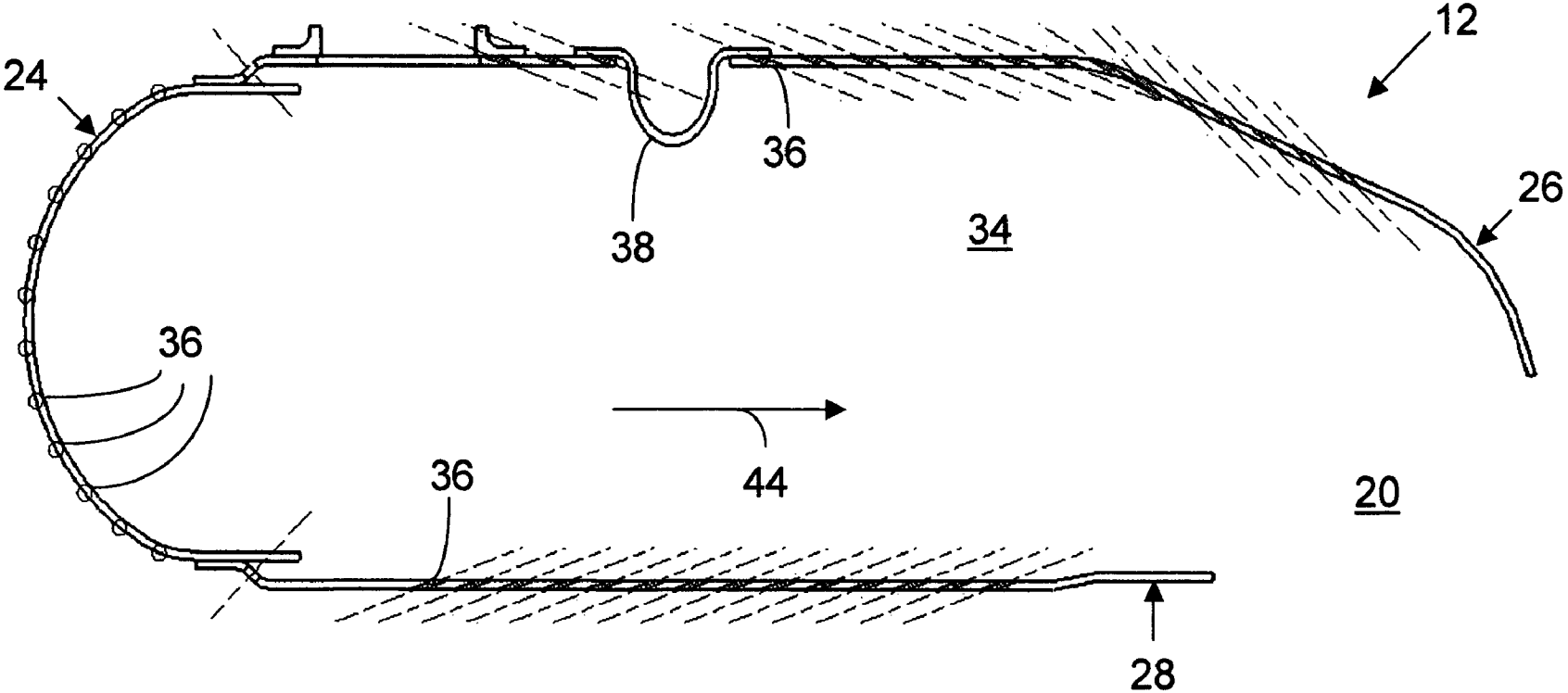
FIG. 11 is a fragmentary sectional side view of a fourth embodiment of the invention that has blast tubes in combination with dome as well as inner and outer liner wall angled cooling holes.

FIG. 11 is a fragmentary sectional side view of a fourth embodiment of the invention. This embodiment is similar to the second embodiment shown in FIGS. 5 through 8, but it also includes the circumferentially angled air blast tubes 38 that further enhance the swirling effect created by the angled cooling holes 36. The operation of the air blast tubes 38 is identical to the third embodiment described above in connection with FIGS. 9 and 10.

It should be noted that the optimum swirl and down angles for the angled cooling holes 36 in the above described embodiments may change for different applications and designs of the combustor 12 and they may also gradually change through a range of angles over the surfaces of the dome 24, outer wall 26 and inner wall 28

Thus there has been described herein an annular combustor that has angled effusion holes through at least one surface of the combustor liner with the angle of the effusion holes oriented to cause the flow of air through the holes to facilitate swirling of the fuel and air within the combustor. The angled effusion holes thereby facilitate efficient cooling of the combustor liner combined with superior fuel/air mixing within the combustor. It should be understood that the embodiments described above are only illustrative implementations of the invention, that the various parts and arrangement thereof may be changed or substituted, and that the invention is only limited by the scope of the attached claims.

What is claimed is:

1. For a gas turbine engine that employs an annular combustor with radial fuel injection, a gas turbine annular combustor that has an annular outlet and a liner with liner surfaces comprising a dome, an outer wall, and an inner wall, comprising:

angled effusion cooling holes in at least one of the liner surfaces that have a swirl angle from the surface in a direction that is generally tangential to the axial flow of combustion gas in the combustor toward the outlet to effectuate swirling of combustion gases in the combustor;

wherein the outer wall and the inner wall have angled cooling holes and the angled cooling holes have both a swirl angle and a downstream angle from the surface in a direction generally parallel the axial flow of combustion gas in the combustor toward the outlet;

and wherein the combustor has a dome with effusion cooling holes and associated cooling strips.

2. The gas turbine combustor set forth in claim 1, wherein the dome has the angled cooling holes.

3. The gas turbine combustor set forth in claim 1, wherein at least one of the outer and inner walls have air blast tubes.

4. The gas turbine combustor set forth in claim 1, wherein the swirl angle is in the range of approximately 45 to 90 degrees.

5. The gas turbine combustor set forth in claim 1, wherein the swirl angle changes gradually over at least one of the liner surfaces.

6. The gas turbine set forth in claim 1, wherein the downstream angle is in the range of approximately 15 to 45 degrees.

* * * * *